United States Patent [19]

Piber

[11] 4,082,934

[45] Apr. 4, 1978

[54] SWITCH WITH ILLUMINATED HANDLE TIP

[75] Inventor: Earl T. Piber, Oconomowoc, Wis.

[73] Assignee: Cutler-Hammer, Inc., Milwaukee, Wis.

[21] Appl. No.: 697,232

[22] Filed: Jun. 17, 1976

[51] Int. Cl.[2] ..... H01H 9/16

[52] U.S. Cl. ..... 200/315; 362/32; 340/380; 116/124 L

[58] Field of Search ..... 116/DIG. 26, 124 L; 340/380; 40/130 L; 240/1 LP, 29; 200/310, 313, 315, 316

[56] References Cited

U.S. PATENT DOCUMENTS

| | | | |
|---|---|---|---|
| B 470,899 | 3/1976 | Ohashi | 200/309 |
| 3,651,296 | 3/1972 | Yarbrough | 200/315 |
| 3,727,020 | 4/1973 | Bailey | 200/167 A |
| 3,819,928 | 6/1974 | Kuroyama | 340/380 |
| 3,916,133 | 10/1975 | Bollinger | 200/308 |
| 4,016,534 | 4/1977 | Kobayashi | 340/380 |

*Primary Examiner*—Gerald P. Tolin
*Attorney, Agent, or Firm*—Hugh R. Rather; William A. Autio; Michael E. Taken

[57] ABSTRACT

A light-transmissive insert mounted in a tunnel in a pivotal operating handle transmitts light from a light source mounted internally of a housing through the handle to appear as a lighted bar at the tip of the handle. The handle is rigidly mounted to an actuator in snap-on relation to allow front of panel relamping. The actuator is of generally inverted L-shape, pivotally mounted to the housing at ends of the horizontal leg of the L, with the vertical leg of the L extending downwardly into the housing to actuate a set of contacts. A stationary light source is mounted in the housing adjacent the vertical leg and extends upwardly through an aperture in the horizontal leg. The aperture is made wide enough to allow clearance of the light source during pivoting of the actuator. The tunnel extends through the handle from the outer end thereof to communicate with the aperture in the horizontal leg of the actuator and thus be exposed to the light source. The light-transmissive insert mounted in the tunnel has an inner end facing the light source throughout pivotal movement of the handle and actuator and acts as a light guide to transmit light through the handle and to concentrate otherwise divergent light rays at the external tip of the handle.

8 Claims, 8 Drawing Figures

SWITCH WITH ILLUMINATED HANDLE TIP

BACKGROUND OF THE INVENTION

The field of the invention relates to illuminated electric switches having a pivotal operating handle, such as tab switches, toggle lever switches, rocker switches, etc., and specifically to means for guiding and directing light, emitted from a stationary source inside the switch housing, through the handle to concentrate the light at the external tip of the handle.

Switches having an externally extending handle pivotally mounted to a housing and illuminated by a light source within the housing are known in the art. Many of these switches have a translucent handle entirely illuminated. In some applications, it is desirable to have only a portion of the handle illuminated, for example, to distinguish it from other switch handles on a panel, or to illuminate only that part of the switch having indicia marked thereon, or to provide a smaller but more intense region of illumination on the handle rather than the lesser intensity of illumination of the whole handle when illuminated, or to readily identify the outermost tip of the handle, etc.

Some switches have used flexible light cables extending through the handle, but these switches suffer the disadvantage of fatigue of the cable after repeated pivoting of the handle. Some switches have a transparent cap or lens placed over the end of a hollow opaque handle, but these switches suffer the disadvantage of low intensity of illumination because only a small portion of light emanating from the source within the housing reaches the lens, most of the light being lost through dispersion and scattering.

Other disadvantages of prior switches include difficulty of relamping; for example, some switches cannot be relamped from the front or can only be relamped with special tools or by removing a bezel or mounting place.

While these prior devices have been useful for their intended purposes, the present invention relates to improvements thereover.

SUMMARY OF THE INVENTION

An object of the invention is to provide an electric switch having a pivotal operating handle illuminated at the tip thereof by a stationary light source within the switch housing.

Another object is to provide a switch of the aforementioned character providing increased intensity of illumination at the tip of the handle by means of a light transmissive insert extending through the handle to be closely facing the light source throughout pivotal movement of the handle for guiding and directing light rays emitted from the source through the handle to emerge at the outer tip of the handle, thus concentrating otherwise divergent light rays at the tip of the handle in addition to those light rays traveling straight through the handle to its tip.

Another object is to provide a switch of the aforementioned character affording front of panel relamping without the need of special tools or removal of a bezel or mounting plate.

Another object is to provide a switch of the aforementioned character having a wide range of display flexibility.

Another object is to provide a switch of the aforementioned character having an actuator pivotally mounted to the switch housing, the operating handle being snap-on mounted to the actuator and interchangeable with other types of operating handles.

Other objects and advantages will hereinafter appear.

DESCRIPTION OF THE PREFERRED EMBODIMENT

Figure 1:
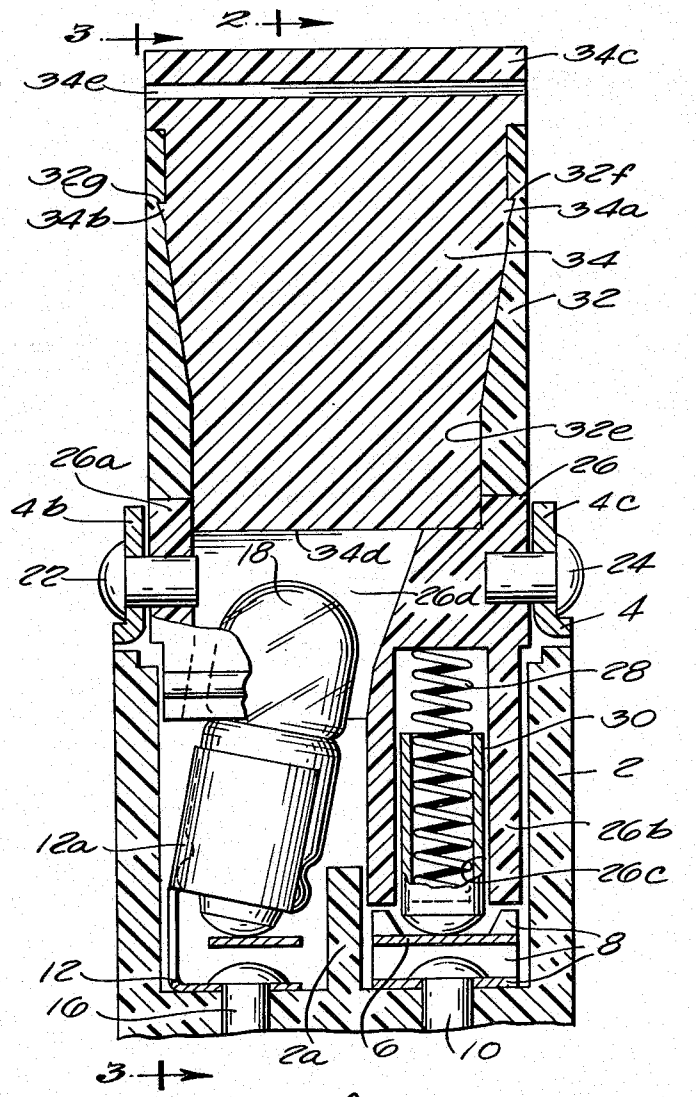
FIG. 1 is a view partly in cross-section and partly in elevation of the preferred form of the present invention.

There is shown in FIGS. 1–4 an illuminated switch constructed in accordance with the invention. A housing comprises a generally rectangular insulating base 2 open at the top and closed by a cover 4, FIG. 4. As shown in FIG. 1, the interior of the base is divided into two compartments by a central dividing wall **2*a*** extending from the bottom of the base upwardly partway into the interior of the base.

Mounted in one compartment is contact means including movable contact 6 supported on cradle 8 mounted by rivet 10. Such teeter-totter type contact means is well known in the art, for example as shown in A. W. Krieger U.S. Pat. No. 2,248,362, dated July 8, 1941. Other kinds of contact means may be used and the invention is not limited to a particular type.

Mounted in the other compartment are lamp terminals 12 and 14. Terminal 12 is mounted to the base by rivet 16 and has arcuate clamp portions **12*a* and 12*b*, FIG. 3, holding a lamp 18 therebetween and making electrical connection therewith. Terminal 14 is mounted to the base by rivet 20 and makes electrical contact with the bottom of the lamp to complete a circuit through the lamp between rivets 16 and 20**.

Figure 4:
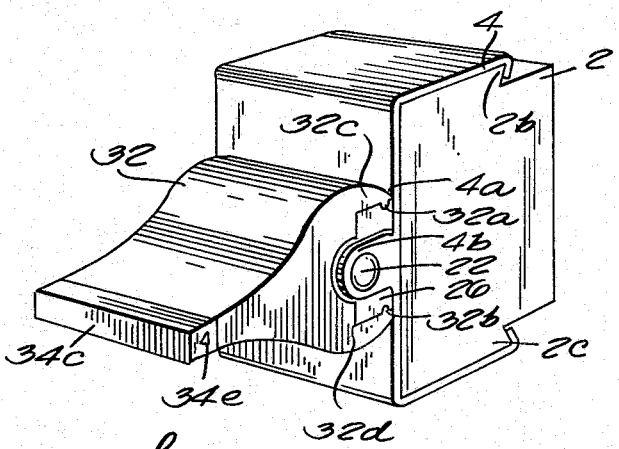
FIG. 4 is an isometric view of the switch of FIGS. 1–3.

As shown in FIG. 4, cover 4 overlies the base and extends partway down the sides thereof with its ends tucked under lips **2*b* and 2*c* formed in the base to thereby mount the cover to the base. The cover has a rectangular aperture 4*a* extending centrally thereacross between a pair of upstanding supports 4*b* and 4*c*, FIGS. 1 and 4, extending from opposite edges of the cover. These supports have aligned holes for receiving rivets 22 and 24 which pivotally mount an actuator 26 extending through aperture 4*a***.

Figure 8:
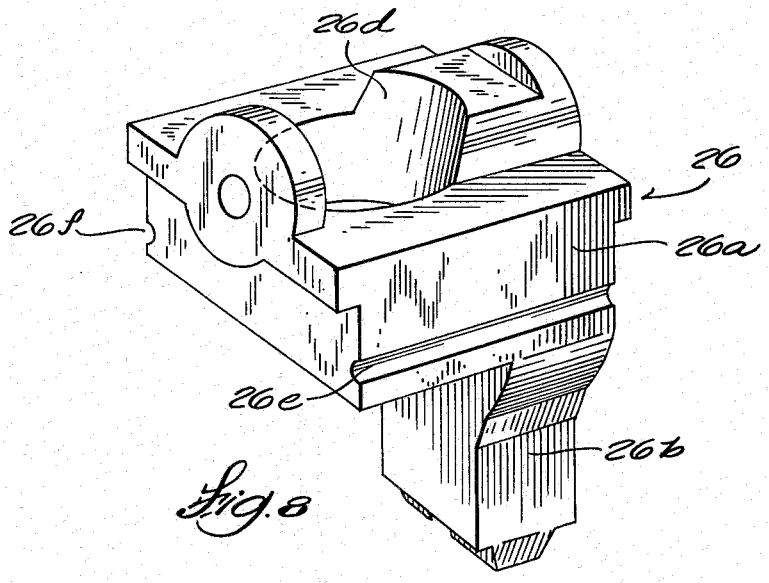
FIG. 8 is an isometric view of the preferred form of the actuator of the present invention.

Actuator 26 is of generally inverted L-shaped configuration, FIG. 8, having a horizontal leg **26*a* with bores formed in each end thereof to receive rivets 22 and 24 for pivotally mounting the actuator in the housing about a pivotal axis coaxial with the horizontal leg 26*a* of the actuator. The actuator has a vertical leg 26*b* extending downwardly into the housing in the compartment of the base having the contact means. As viewed in FIG. 1, vertical leg 26*b* rocks into and out of the page. Leg 26*b*** has a downwardly opening longitudinal vertical bore 26c formed therein for receiving a helical compression spring 28 and a plunger 30 for actuation of the contact means as described in said Krieger patent.

Horizontal leg 26a has an aperture 26d formed therethrough generally above the compartment having the lamp. The lamp is slightly canted toward the center of the switch, FIG. 1, and extends upwardly, adjacent vertical leg 26b, partway into aperture 26d, with the uppermost tip of the lamp proximate the pivotal axis of the actuator. Aperture 26d is made wide enough, FIG. 2, to allow clearance of the lamp as the actuator is pivoted.

Figure 2:
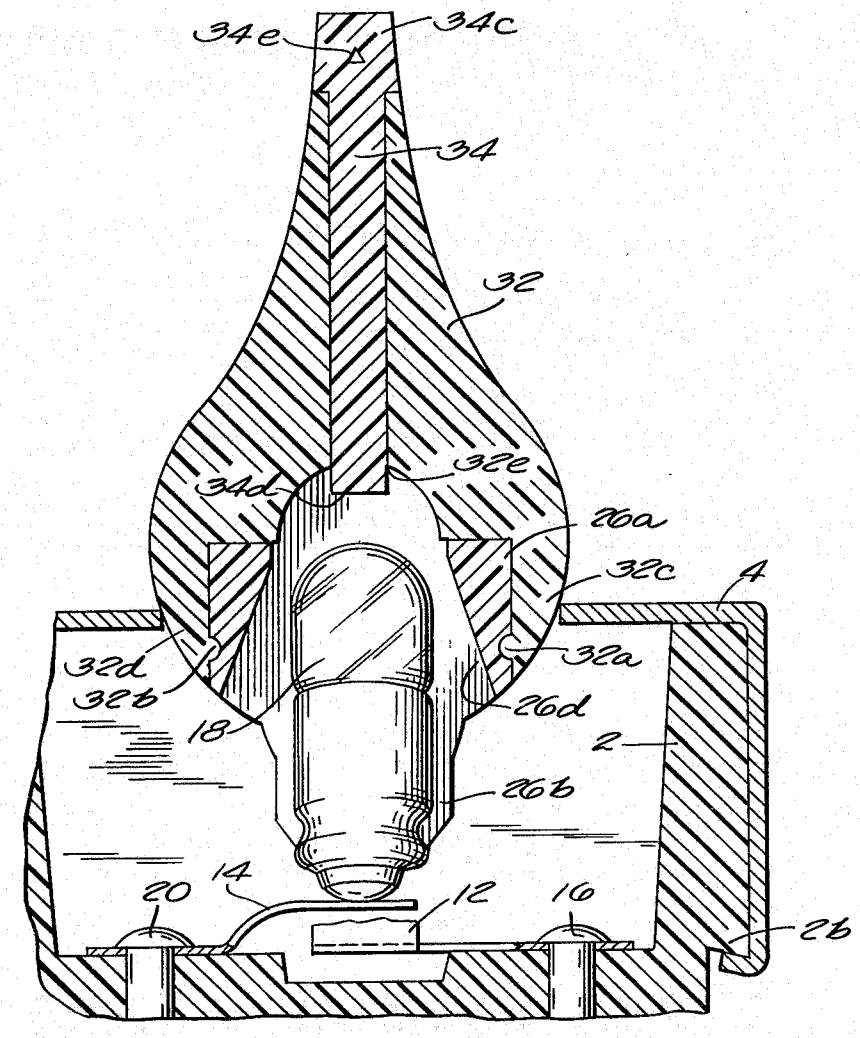
FIG. 2 is a view partly in cross-section and partly in elevation generally taken along line 2—2 of FIG. 1.
Figure 3:
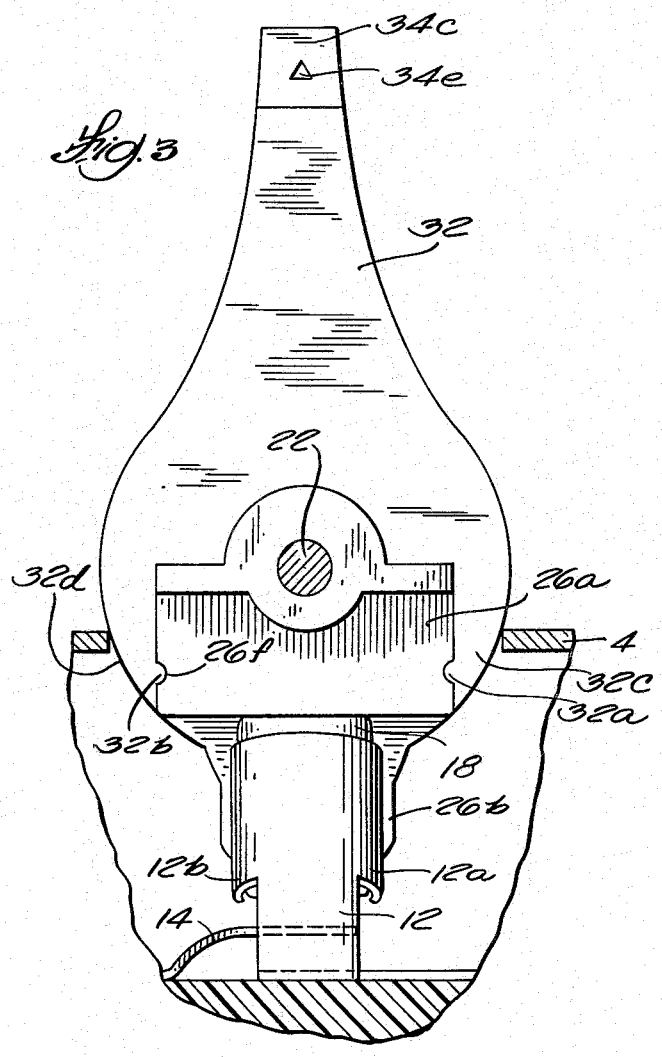
FIG. 3 is an elevational view generally taken along line 3—3 of FIG. 1, showing a side view of the switch of FIG. 1 with the side wall of the housing cut away.
Figure 7:
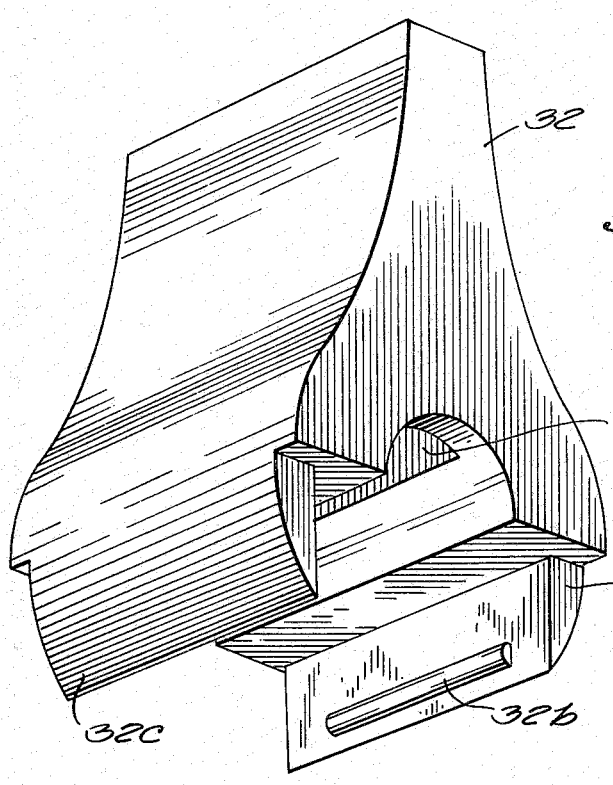
FIG. 7 is an isometric view of the preferred form of the operating handle of the present invention.

An operating handle 32, FIG. 7, is rigidly mounted to the actuator in snap-on relation by means of lateral elongated protrusions 32a and 32b, FIGS. 2 and 7, formed on downwardly extending sides 32c and 32d, which fit in grooves 26e and 26f, FIG. 8, of the actuator. This handle is an opaque insulating member having a flattened tunnel 32e extending longitudinally vertically therethrough, as seen in FIGS. 1, 2 and 7, to communicate with aperture 26d and thus the interior of the housing. As shown in FIG. 2, the tunnel has flat, smooth, planar side walls.

Figure 5:
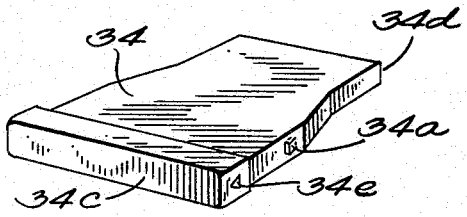
FIG. 5 is an isometric view of the preferred form of the light-transmitting insert of the present invention.

Mounted in the tunnel is a rigid member or insert 34, FIG. 5, made of light-transmissive material. The insert and tunnel have complemental configurations to assure a tight fit, the insert being held in the tunnel by means of flared nibs 34a and 34b formed thereon, FIG. 1, fitting in notches 32f and 32g in the tunnel and by means of the widened head 34c of the insert stopped against the top of the handle. As shown in FIGS. 1 and 2, the insert extends all the way through the tunnel and projects beyond the outer end of the handle such that head portion 34c of the insert forms the outer tip of the handle. The inner flat end 34d of the insert projects beyond the inner end of the tunnel to closely face the lamp proximate the pivotal axis of the actuator and remain in close facing relationship with the lamp throughout movement of the handle and actuator as the inner flat end of the insert moves in an arc about the stationary lamp.

Referring to FIG. 2, it is seen that light rays emanating from lamp 18 and entering the insert normal to flat surface 34d will pass straight through the insert to emerge at the head portion 34c. The same number of these light rays would, of course, emerge at the outer end of the handle if only a cap or lense were placed thereover. However, in the present invention, other light rays striking surface 34d at an angle other than substantially 90° will, instead of being diminished or lost by dispersion and scattering, be refracted into the insert and reflected by the side walls therein to be transmitted and guided therethrough to emerge at the outer end of the handle. The insert thus enables more of the light emitted from the lamp to appear at the tip of the handle by guiding and transmitting divergent rays which would otherwise be lost or diminished. In this manner the insert acts as a light concentrating means to increase the intensity of illumination at the tip of the handle.

Head portion 34c thus appears as an illuminated bar at the tip of the handle. As aforedescribed, this lighted bar is brighter than a cap or lens placed over the end of a hollow handle because the bar is illuminated not only by light rays going straight through the tunnel but also by light rays which enter the tunnel at an angle and are guided and transmitted by the insert to the bar, the insert thus concentrating such divergent rays at the tip of the handle to increase the intensity of illumination thereof and afford more efficient use of light source 18.

Because lamp 18 is proximate the pivotal axis, inner surface 34d of the insert will remain substantially the same distance away from the lamp throughout pivotal movement of the handle and thus the tip of the handle will have substantially the same brightness through its movement.

Figure 6:
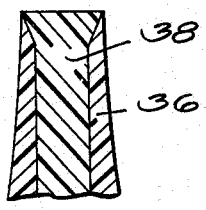
FIG. 6 is a partial isolated cross-sectional view of an alternate insert and handle.

The present invention offers a wide range of display flexibility. For example, a hole, such as triangular hole 34e, may be formed through head portion 34c of the insert to scatter emergent light rays and enhance side illumination of the tip of the handle. Many other such divergence means are possible. The display may also include indicia marked in head portion 34c if desired, as well as colored inserts to provide, for example, differentiation of handles on a panel. Many variations of handle and insert configuration are also possible; for example, FIG. 6 shows a portion of a handle 36 and insert 38 wherein only the end face, not the sides, of the handle tip is illuminated.

Many types of handles may be used other than the tap type shown in the drawings. Since the handle can be snapped on the actuator, alternate handles can be used interchangeably. This snap-on mounting also affords convenient front of panel relamping without the necessity of special tools or removal of a bezel or mounting plate.

It is thus seen that the present invention affords a switch having pivotal operator means illuminated at the tip thereof by a light source within the housing. The structure of the operator means allows contact means and a stationary light source to be mounted in a compact housing and also allows the light source to extend proximate the pivotal axis and the insert to extend towards the light source to be in close facing relation therewith. The insert serves to direct otherwise divergent light rays into the tunnel, guiding and transmitting such rays therethrough, in addition to those rays which go straight through, thus concentrating more of the light emitted by the source at the tip of the operator means thereby providing a brighter display.

While specific embodiments of the present invention have been shown and described, it is recognized that various modifications are possible within the scope of the appended claims.

I claim:

1. An electric switch comprising:

a housing having an opening;

contact means mounted in said housing;

an actuator pivotally mounted to said housing at said opening and extending internally of said housing for actuating said contact means;

a stationary light source mounted in said housing and having a light emitting surface proximate the pivotal axis of said actuator at said opening;

an operating handle rigidly mounted to said actuator at said opening and extending externally of said housing, and having an elongated tunnel formed therethrough extending from an outer tip thereof longitudinally inwardly to communicate with said light source; and an elongated rigid light-transmissive insert extending through, complementally configured to, and mounted in said tunnel to have an externally visible outer end at said outer tip and an inner end closely facing said light emitting surface and defining an arc of substantially constant radius thereabout during pivoting of said handle and said actuator, said inner end of said insert extending inwardly beyond the inner edge of said tunnel to direct otherwise divergent light rays into said tunnel, guiding and transmitting such rays therethrough, in addition to those light rays going straight through said tunnel, thereby providing increased intensity of illumination at said outer tip of said handle.

2. The switch according to claim 1 wherein said insert is of sheet-like generally planar configuration such that said outer end of said insert appears as a lighted bar at said outer tip of said handle.

3. The switch according to claim 2 wherein said outer end of said insert protrudes beyond said handle and includes light divergence means to enhance side illumination thereof.

4. An electric switch comprising:

a housing having an opening;

contact means mounted in said housing;

an actuator pivotally mounted to said housing at said opening and extending internally of said housing for actuating said contact means;

a stationary light source mounted in said housing and having a light emitting surface proximate the pivotal axis of said actuator at said opening;

an operating handle rigidly mounted to said actuator at said opening and extending externally of said housing, and having an elongated tunnel formed therethrough extending from an outer tip thereof longitudinally inwardly to communicate with said light source; and an elongated rigid light-transmissive insert extending through, complementally configured to, and mounted in said tunnel to have an externally visible outer end at said outer tip and an inner end closely facing said light emitting surface and defining an arc of substantially constant radius thereabout during pivoting of said handle and said actuator, said insert serving to direct otherwise divergent light rays into said tunnel, guiding and transmitting such rays therethrough, in addition to those light rays going straight through said tunnel, thereby providing increased intensity of illumination at said outer tip of said handle, wherein said opening is formed in a top horizontal wall of said housing, and said actuator comprises an inverted generally L-shaped member having a horizontal leg extending across said opening and pivotally mounted to said housing at the ends of said horizontal leg and having a vertical leg extending downwardly into said housing to engage said contact means, said light source extending generally upwardly adjacent said vertical leg through an aperture formed in said horizontal leg such that said light emitting surface of said light source is proximate said pivotal axis of said actuator, said aperture in said horizontal leg being wide enough to allow clearance of said light source as said actuator is pivoted.

5. The switch according to claim 4 wherein said handle is removably snap-on mounted to said actuator to afford replacement of said light source from the top of the switch through said aperture in said horizontal leg.

6. An electric switch comprising:

a housing having an opening;

contact means mounted in said housing;

operating actuator means pivotally mounted to said housing at said opening, extending externally of said housing and extending internally of said housing for actuating said contact means, and having an elongated tunnel formed therethrough extending from an outer tip thereof longitudinally inwardly to communicate with the interior of said housing;

a stationary light source mounted in said housing and having a light emitting surface proximate the pivotal axis of said operating actuator means at said opening; and an elongated rigid light-transmissive insert extending through, complementally configured to, and mounted in said tunnel to have an externally visible outer end at said outer tip and an inner end closely facing said light emitting surface and defining an arc of substantially constant radius thereabout during pivoting of said handle and said actuator, said inner end of said insert extending inwardly beyond the inner edge of said tunnel to direct otherwise divergent light rays into said tunnel, guiding and transmitting such rays therethrough, in addition to those light rays going straight through said tunnel, thereby providing increased intensity of illumination at said outer tip of said operating actuator means.

7. An electric switch comprising:

a housing having an opening;

contact means mounted in said housing;

operating actuator means pivotally mounted to said housing at said opening, extending externally of said housing and extending internally of said housing for actuating said contact means, and having an elongated tunnel formed radially therethrough with respect to the pivotal axis thereof and extending from an outer tip thereof longitudinally inwardly to communicate with the interior of said housing;

a light source mounted in said housing and having a light emitting surface proximate said pivotal axis; and a light-transmissive insert complementally configured to and mounted in said tunnel to have an externally visible outer end and an inner end closely facing said light emitting surface and defining an arc of substantially constant radius thereabout during pivoting of said operating actuator means to afford consistency of illumination of said outer end regardless of the pivoted position of said operating actuator means.

8. An electric switch comprising:

a housing having an opening;

contact means mounted in said housing;

operating actuator means pivotally mounted to said housing and having an outer section extending externally of said housing and having an inner section extending internally of said housing for actuating said contact means, and having a tunnel formed through said outer section to communicate with the interior of said housing;

a light source mounted in said housing; and a light transmissive insert mounted in said tunnel;

wherein said opening is formed in a top horizontal wall of said housing, and said inner section comprises an inverted generally L-shaped member having a horizontal leg extending across said opening and pivotally mounted to said housing at the ends of said horizontal leg and having a vertical leg extending downwardly into said housing to engage said contact means, said light source extending generally upwardly adjacent said vertical leg through an aperture formed in said horizontal leg, said aperture in said horizontal leg being wide enough to allow clearance of said light source as said actuator is pivoted.

* * * * *